US006526153B2

(12) United States Patent
Tibbetts et al.

(10) Patent No.: US 6,526,153 B2
(45) Date of Patent: Feb. 25, 2003

(54) ARMATURE ASSEMBLY FOR BALANCED MOVING ARMATURE MAGNETIC TRANSDUCER AND METHOD OF LOCATING AND ADJUSTING SAME

(75) Inventors: George C. Tibbetts, Camden, ME (US); Joseph A. Sawyer, Camden, ME (US)

(73) Assignee: Tibbetts Industries, Inc., Camden, ME (US)

( * ) Notice: Subject to any disclaimer, the term of this patent is extended or adjusted under 35 U.S.C. 154(b) by 0 days.

(21) Appl. No.: 09/779,920

(22) Filed: Feb. 8, 2001

(65) Prior Publication Data

US 2002/0125972 A1 Sep. 12, 2002

(51) Int. Cl.[7] ..... H01R 1/00; H01R 11/02; H01R 9/06

(52) U.S. Cl. ..... 381/412; 381/417

(58) Field of Search ..... 335/220–229, 335/231, 252, 266–268, 269, 270, 271, 273, 281–285; 381/412, 417

(56) References Cited

U.S. PATENT DOCUMENTS 3,163,723 A 12/1964 Tibbetts
3,185,779 A 5/1965 Sawyer
3,515,818 A * 6/1970 Tibbetts ..... 335/273
4,272,654 A * 6/1981 Carlson ..... 29/594
4,410,769 A 10/1983 Tibbetts
4,518,831 A 5/1985 Stanley et al.
6,075,870 A * 6/2000 Geschiere et al. ..... 381/417

* cited by examiner

*Primary Examiner*—Lincoln Donovan
(74) *Attorney, Agent, or Firm*—Lahive & Cockfield, LLP

(57) ABSTRACT

In a folded armature assembly the vibratory end portion of the armature is prelocatable both translationally and rotationally relative to the facing pole surfaces of the permanent magnetic flux means before attachment of the supported portion of the armature to said means. The armature has wings extending laterally from the supported portion to form therewith a connecting bridge portion, and the wings are formed to provide pads extending normal to the bridge. A magnet strap with attached magnets fits slidably between the pads, with a clearance from the bridge of the armature, to permit said locations before the parts are permanently attached. After attachment and with the magnets magnetized, the armature may be adjusted substantially in translation to magnetic center between the pole faces by appropriate plastic deformation of the bridge. In a preferred embodiment, an improved structure is provided for viscoelastic damping of the undesirable second natural resonant mode of the folded armature.

10 Claims, 4 Drawing Sheets

FIG. 7
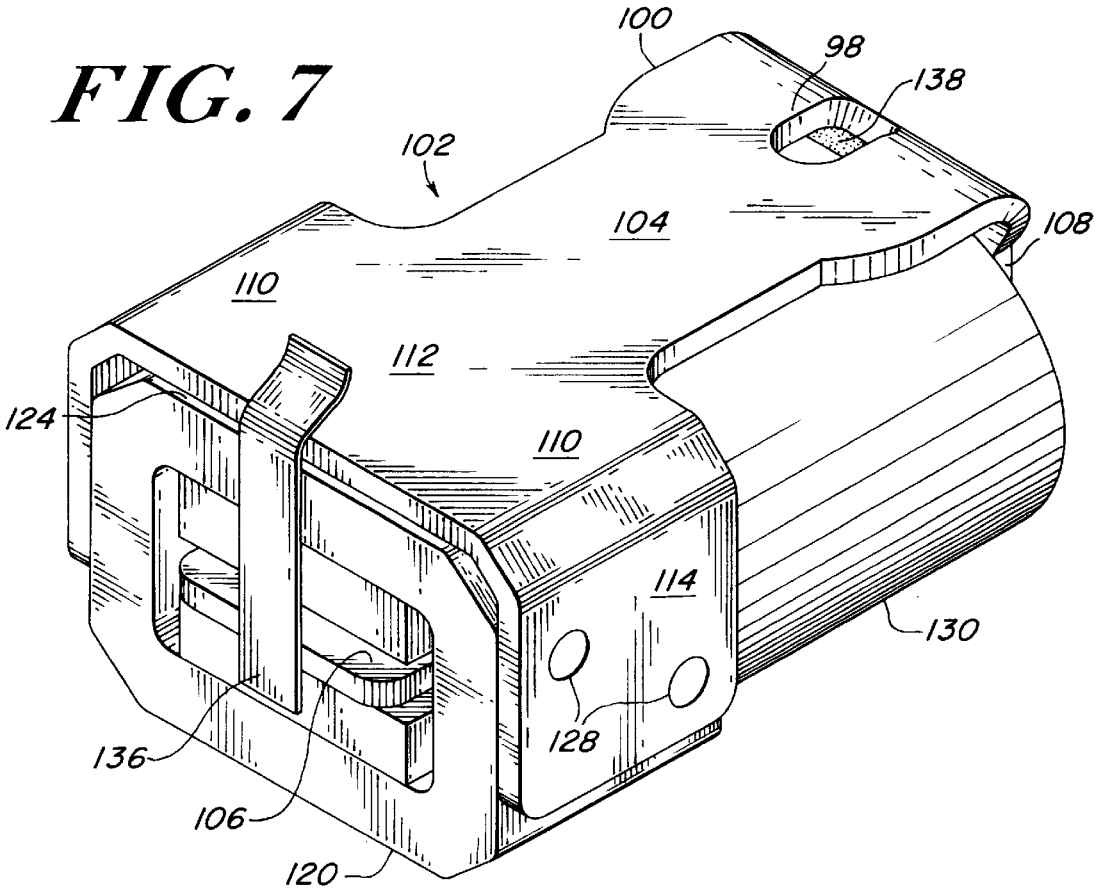
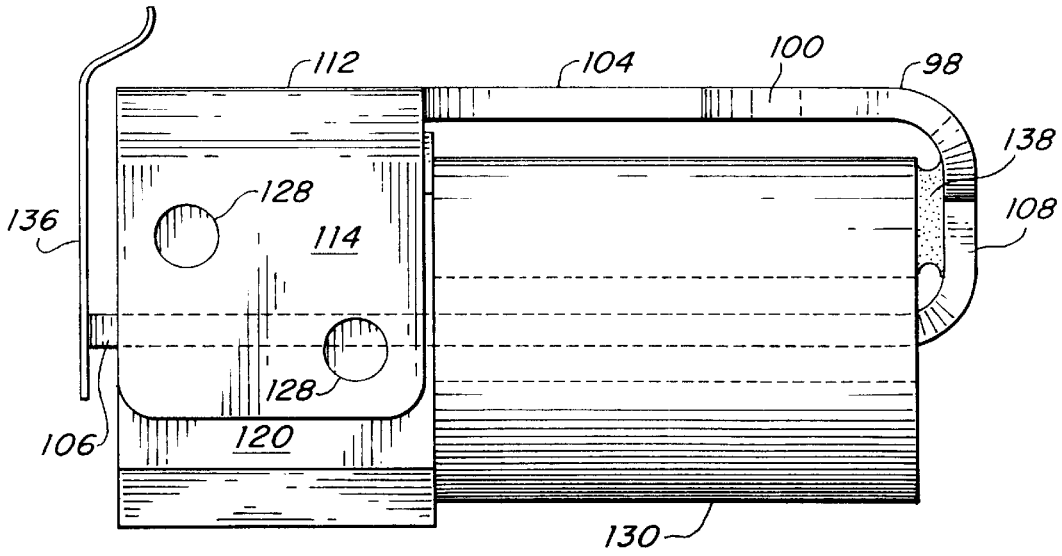
FIG. 8

ARMATURE ASSEMBLY FOR BALANCED MOVING ARMATURE MAGNETIC TRANSDUCER AND METHOD OF LOCATING AND ADJUSTING SAME

BACKGROUND OF THE INVENTION

This invention relates generally to moving armature magnetic transducers, and more particularly to armature assemblies designed to facilitate the positioning of a vibratory portion of the armature relative to the pole faces which establish a permanent magnetic flux.

The armature in these transducers is generally formed from strip material and extends between a pair of spaced magnetic poles having flat, parallel facing surfaces each forming a gap therewith. It is generally important for an armature portion to be parallel to the facing pole surfaces. It is also important to locate the surfaces of the armature portion relative to the respective facing pole surfaces. Both of these conditions affect the intensity and distribution of varying magnetic flux during operation of the transducer. The difficulties of establishing these locations are compounded for applications requiring very small physical dimensions as in hearing aids.

Earlier designs relied on manufacturing the transducer to close dimensional tolerances, so that when assembled the parts approximate the desired relative locations. Alternatively, various methods have been devised for adjusting the relative positions of the parts after assembly, as in U.S. Pat. Nos. 4,410,769 and 4,518,831. In these methods the elements of moving armature transducers have been chosen according to suitability for particular methods of post-assembly adjustment. In turn, in these prior art post-assembly adjustable structures, the configuration of the overall motor unit of the transducer tends to confer a rather high degree of rectangularity on the cross-sectional shape of the complete transducer.

When a blockier cross-sectional shape of the transducer is desired for particular end applications, a folded armature motor unit typically is better adapted to this need.

U.S. Pat. No. 3,185,779 to one of the present applicants originated the folded armature transducer in the prior art. A folded elongate armature having the end of one arm fixed to a plate as by spot welding has the vibratory end of the other arm extending into a space between two spaced magnets. The magnets are attached in fixed relation to the plate during assembly of the transducer. The accuracy of position of the vibratory end of the armature in the magnet space depends largely upon the precision to which it is practicable to form and heat treat the folded armature, starting its fabrication typically with a flat strip of material. Similar considerations apply to subsequent prior art designs employing folded armatures.

In these now conventional prior art folded armature transducers, it is not generally practicable to adjust the armature position mechanically after assembly. Also, during assembly it is generally not practicable to vary the location of the armature in a manner which minimizes the amount of required post-assembly adjustment by whatever method, such as differential demagnetization of the magnet pair.

BRIEF SUMMARY OF THE INVENTION

For the purpose of improving the precision and ease of controlling the position of the vibratory end of a folded armature in relation to the pole faces, and at the same time reducing manufacturing costs, the features of this invention include a folded armature having integral wings extending laterally from the supported portion of the armature, the wings being formed to provide mutually parallel pads extending normal to the supported portion. The supported portion and the laterally extending portions of the wings together form a bridge between the pads. The parts forming the permanent magnetic flux means comprise a pair of spaced parallel, initially unmagnetized magnets affixed to the inner surfaces of a closed loop magnet strap which has a parallel set of outer surfaces to fit between the pads. In assembly, the magnet strap is fitted slidably between the pads with a clearance from the bridge of the armature and with the vibratory end of the armature extending between the magnets.

Prior to this assembly, however, an electrical coil having a hollow bore is attached as by adhesive to the magnet strap, its bore being aligned with the magnet strap's aperture. During assembly the vibratory end of the armature is threaded through the bore of the coil to extend between the magnets.

In the assembly process, the position of the pads on the magnet strap is slidably adjusted to vary the position of the vibratory end of the armature, both rotationally to bring it into parallelism with the facing surfaces of the magnets, and translationally with respect to its spacing between them. After the desired location is established, the pads of the armature are permanently attached to the magnet strap as by laser welding. At that point a drive pin may be attached to the vibratory end of the armature slightly beyond the magnet strap, and then the magnets are magnetized, as by a unidirectional magnetic field pulse of external origin, thereby establishing a permanent magnetic flux in the magnet space and defining a magnetic center between the pole faces of the magnets where the vibratory end of the armature should be ideally located.

A feature of this invention is that the novel configuration of the armature, and the spacing between the bridge of the armature and the magnet strap, permit adjustment of the armature to or toward magnetic center by plastic deformation of the bridge of the armature extending between its pads. In response to this adjustment the vibratory end of the armature is moved essentially in translation relative to the pole faces of the magnets so as to approximately maintain its intrinsic parallelism thereto.

DESCRIPTION OF THE DRAWINGS

FIG. 7 is an isometric view of a preferred embodiment of the invention.

FIG. 8 is a side elevation of the embodiment of FIG. 7.

DESCRIPTION OF THE EMBODIMENT OF FIG. 1

Figure 1:
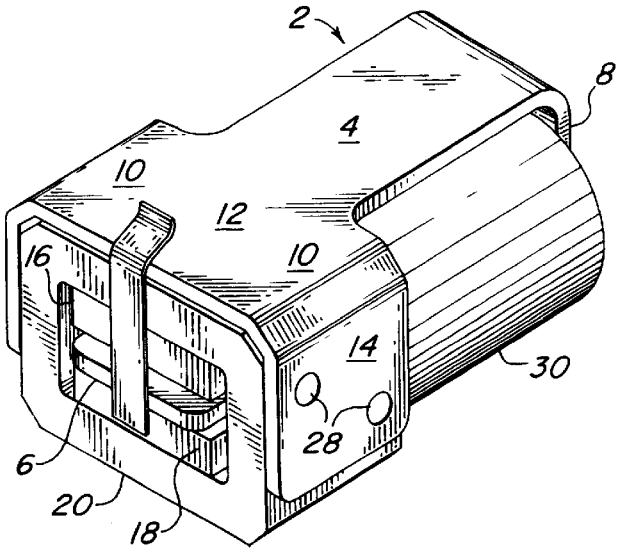
FIG. 1 is an isometric view of one embodiment of a balanced moving armature magnetic electromechanical transducer according to the invention.

Referring to the drawings, an armature 2 is formed from a flat strip of magnetically permeable sheet material and folded, and thereafter heat treated, to form an elongate supported but vibratory outer arm 4, an elongate vibratory arm 6, and an integral connecting portion 8, the arms 4 and 6 being generally parallel. From the supported arm 4 a pair of integral wings 10 extend laterally. The supported arm and the laterally extending portions of the wings together form a bridge 12 between pads 14. The pads 14 are formed normal to the nominal plane of the bridge 12 of the supported arm 4 and are mutually parallel.

A pair of flat, rectangular, initially unmagnetized permanent magnets 16 and 18 are secured as by adhesive to the inner surfaces of a generally O-shaped closed loop magnet strap 20, and provide parallel, spaced, facing pole surfaces. The magnets and magnet strap form a subassembly that is completed before assembly with the armature.

The magnet-strap subassembly is slidably fitted to and between the pads 14 of the armature with the arm 6 extending between the pole surfaces. Gaps 22 are defined between the pole surfaces and the facing surfaces of the arm 6. The respective parts are assembled with a clearance space 24 between the bridge 12 of the armature and the magnet strap 20.

The sliding fit between the magnet strap 20 and the pads 14 permits translational location in the direction of arrow 26 or the opposite direction to vary the gaps 22 between the surfaces of the arm 6 and the respective facing pole surfaces of the magnets 16 and 18. In addition, rotational location is permitted about axes normal to the planes of the pads 14 to achieve parallelism of the arm 6 relative to the facing pole surfaces.

After the foregoing locations are achieved, the magnet strap is permanently secured to the pads 14, for example by laser welds 28. Thus the permanent attachment of the armature is not completed until the foregoing locations have both been made to predetermined tolerances.

The electromechanical transducer assembly requires, in addition to the armature and permanent magnetic flux means, a hollow bore electrical coil 30 through which the arm 6 is threaded. Preferably the coil is bonded at one end by adhesive to the magnet strap and to the magnets of the magnet-strap subassembly. In subsequent assembly the coil is inserted over the arm 6, during the completion of which the magnet strap 20 is inserted between the pads 14 as previously described.

Figure 2:
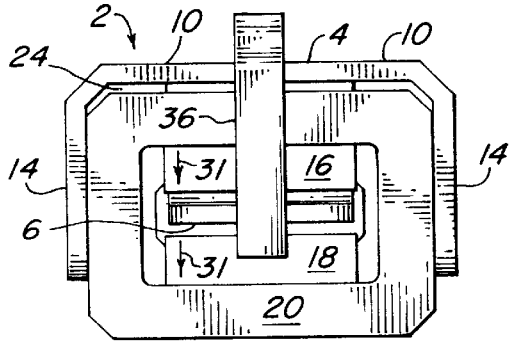
FIG. 2 is a front elevation of the embodiment of FIG. 1.
Figure 3:
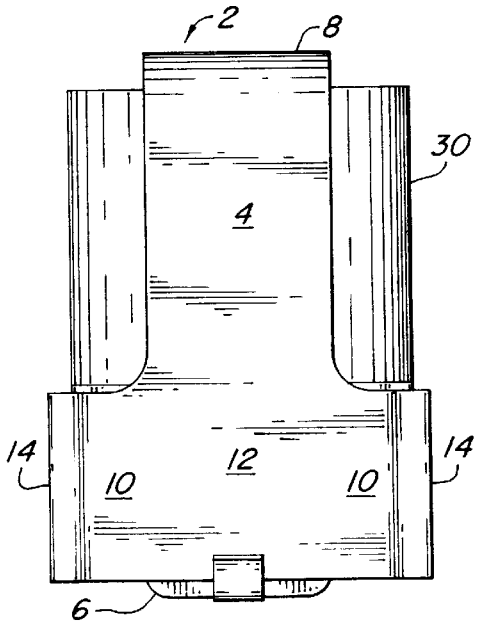
FIG. 3 is a plan view of the embodiment of FIG. 1.

After the welding of the armature pads 14 to the magnet strap, the structure of the motor unit of FIG. 1 may be completed by the welding of a drive pin 36 to the end of arm 6 protruding outward beyond the magnets. Optionally, in addition the motor unit may be laser welded at its magnet strap, opposite the bridge 12, to attach the motor unit within a casing for the entire transducer. Then in a suitable fixture the motor unit assembly is subjected to a sufficiently strong unidirectional magnetic field pulse of external origin to magnetize the magnets 16 and 18 in the direction indicated in FIG. 2 by arrows 31, or alternatively in the opposite direction.

Figure 4:
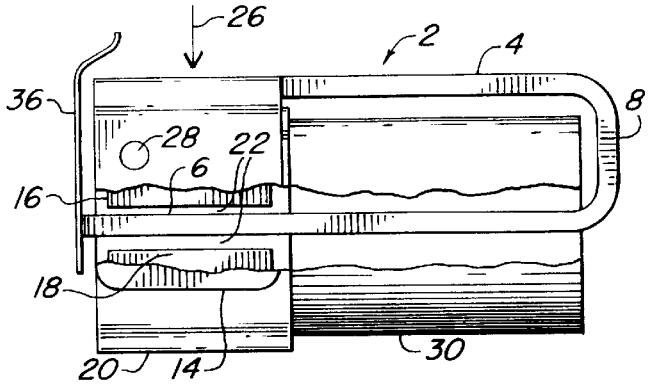
FIG. 4 is a side elevation of the embodiment of FIG. 1.

The resulting permanent magnetic flux establishes a magnetic center between the facing pole pieces of the magnets where the arm 6 is ideally to be located. Final adjustment of the armature to that position can then be performed. For this purpose an adjust punch 32 (FIG. 5) is placed over the bridge 12. The punch 32 has a cylindrical bore 34 for location of and attachment to additional tooling (not shown). The adjustment is made by controllably forcing the punch against the bridge 12 to deform it plastically, thereby moving the arm 6 approximately in translation in the direction of the arrow 26 in FIG. 4, without appreciably affecting its parallel relationship to the pole faces of the magnets. Since the adjustment can be effected in one direction only, it is desirable to locate the arm 6, during initial location prior to making the welds 28, slightly above the anticipated magnetic center. This method of adjustment has been found to be very effective, and, in addition to being essentially translational, very much less susceptible to mechanical shock damage as compared to making crude plastic deformation adjustment efforts at other points along the armature.

The assembly comprising the armature, permanent magnetic flux means, and coil, may be incorporated as the motor unit of an electroacoustic transducer. The drive pin 36 is secured as by laser welding to the extension of the arm 6 and extends above the bridge 12 and arm 4 of the armature. The motor unit is welded into the inside bottom of a drawn cup-like casing, after which the electrical leads from the coil are connected to a terminal board attached to an outside wall of the casing. The casing is of heat treated magnetically permeable material for magnetic shielding purposes. Then the foregoing adjustment of the arm 6 to magnetic center is made, and thereby any magnetic disturbance due to the close proximity of the case to the region of the gaps 22 is automatically compensated for when the motor unit is adjusted in the casing. Thereafter a flexible diaphragm is placed in and peripherally supported by the casing above the arm 4 of the armature, and the other end of the drive pin is attached to a vibratable part of the diaphragm.

DESCRIPTION OF THE PREFERRED EMBODIMENT

Folded armature structures are frequently used in the contemporary state of the art in balanced moving armature magnetic transducers. However, in such structures there exists an undesirable second natural resonant mode of vibration of the armature that is not greatly higher in frequency than the first or fundamental mode. In this second mode the amplitude of vibration of the folded "end" of the armature is much greater than that at the drive point or vibratory end of the armature. That is, with reference to FIG. 4, in the second mode the vertical vibration of the connecting portion 8 is greater than the vertical vibration of the pin 36.

This effect is well known, and the damping of the second mode of vibration of folded armatures is addressed in U.S. Pat. No. 3,163,723. That patent refers to the deleterious effect of the undamped second mode on the electroacoustic response of a particular described transducer incorporating a folded armature structure. On the other hand, in many folded armature transducer structures, the second mode is at a frequency significantly greater than the upper cutoff frequency of the overall transducer. In the latter structures, therefore, the second mode may not have a similar deleterious effect on the electroacoustic response.

However, in the absence of damping there remains a problem that is not discussed in U.S. Pat. No. 3,163,723, and one which has significance differing from that of electroacoustic response. Although the coupling generally is poor between the drive pin and the folded end of the armature, or between the magnetic forces and the folded end, the Q of the resonance can be so high that the lack of damping of the second mode can enable or cause mechanical oscillation in highly compact systems such as hearing aids. This is because vibration of the armature in any mode causes vibration of the transducer casing, which in turn is considerably coupled to the microphone of the system, and the microphone by virtue of its effective accelerometer sensitivity returns a corresponding electrical signal to the input of the amplifier, closing the feedback loop. Accordingly, significant damping of the second mode of a folded armature transducer, to greatly reduce the Q of that resonance, generally is necessary for practical utility of the transducer in certain applications such as hearing aids.

Figure 6:
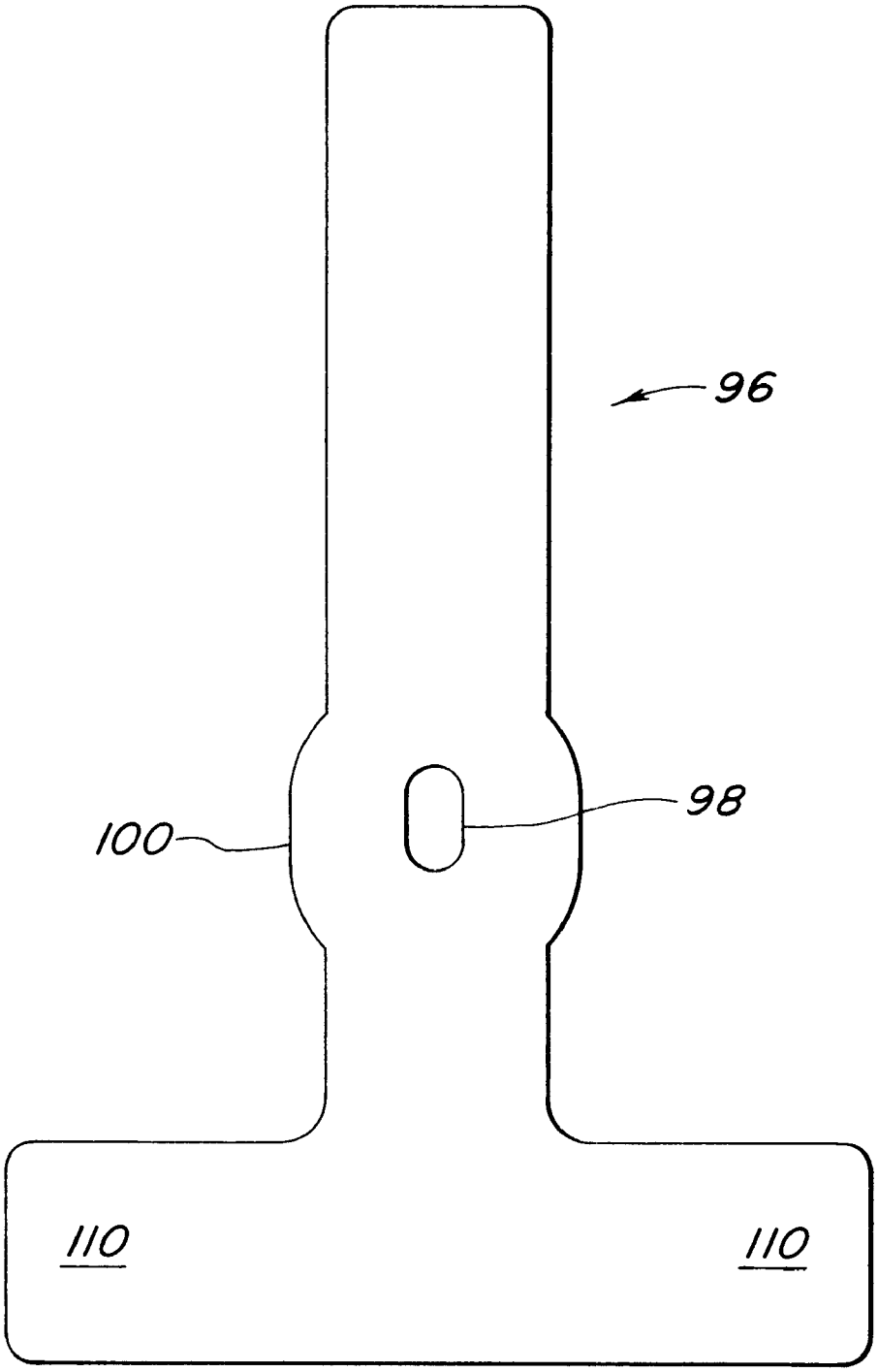
FIG. 6 is a plan view of a flat armature blank used in the preferred embodiment of FIGS. 7 and 8.

In FIG. 6 is shown an armature blank 96 having an aperture 98 for the subsequent application of damping material. The plan view of the blank 96 shows a bulge 100 to at least maintain its effective area in the region of the aperture 98, and thereby to maintain the magnetic flux carrying capability of the armature near magnetic saturation. The blank 96 has wings 110 corresponding to the wings 10 in FIGS. 1–4.

In FIGS. 7 and 8 the preferred embodiment that incorporates the desired damping is shown. An armature 102 is formed and heat treated from the blank 96 of FIG. 6. The armature has an outer supported but vibratory arm 104, a vibratory arm 106 extending through the bore of a coil 130, a connecting portion 108, the wings 110, a bridge 112, and pads 114 attached by laser welds 128 to a magnet strap 120. A drive pin 136 may be welded to the outer end of the arm 106.

Figure 5:
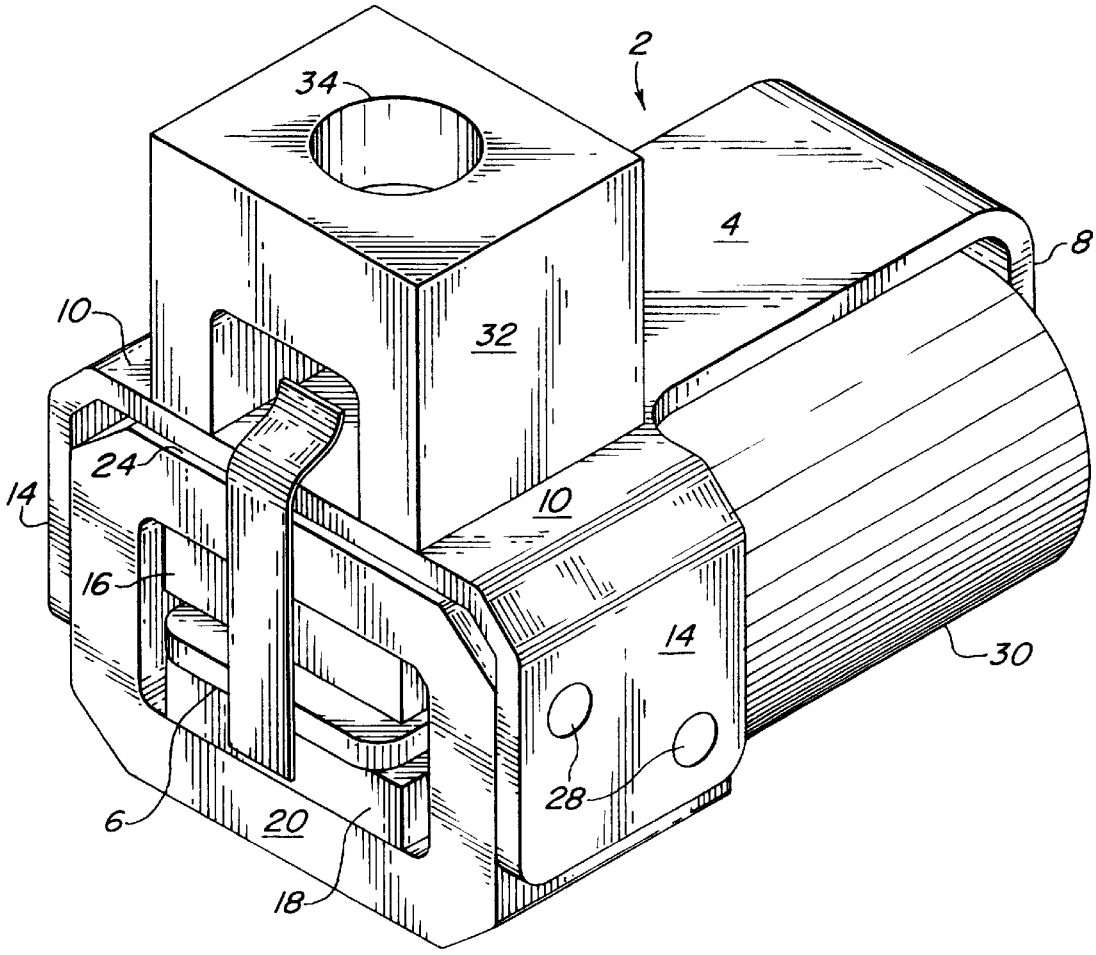
FIG. 5 is an isometric view of the embodiment of FIG. 1, showing an adjust punch for adjusting the armature to magnetic center according to the invention.

After the final mechanical adjustment of the motor unit, as by the method illustrated in FIG. 5, viscoelastic damping material 138, initially in liquid form, is applied under pressure through a fine hollow needle inserted temporarily in the aperture 98. The aperture 98 is elongate to allow ready insertion of the application needle, and also to minimize undesirable capillary attraction of the still-liquid damping material 138 into the horizontal space between the arm 104 and the coil 130. After the release of solvent, or after some cross-linking as by ultraviolet irradiation, the damping material 138 becomes a firm gel that resides stably in position primarily between the connecting portion 108 and the upper rim of the end of the coil 130. The desired position of the damping material 138 is shown idealized in FIG. 8.

In this position the damping material 138 moves primarily in shear, as is desired, between its faces bonded respectively to the connecting portion 108 and the coil, as the armature 102 vibrates. Because of its viscoelectric properties and its position in the structure, the damping material 138 acts effectively to damp substantially the second natural mode of vibration of the armature 102, while having minimal stiffness effect on the electromechanical coupling coefficient of the motor unit.

What is claimed is:

1. An armature assembly for an electromagnetic transducer having, in combination, a vibratory armature comprising a flat sheet of magnetic material folded to form an elongate, planar, vibratory supported arm and an elongate, planar, vibratory second arm in a plane spaced from and parallel to the plane of the supported arm, the supported and second arms being each joined at one end to the other by an integral connecting portion, and a pair of integral wings having portions extending in opposite directions from the other end of the supported arm and laterally of its direction of elongation, the supported arm and said portions of the wings extending laterally therefrom forming an integral bridge, the wings having portions forming mutually parallel pads extending normal to the plane of said supported arm, a pair of parallel magnets having mutually facing, spaced pole surfaces, said second arm of the armature extending between said magnets, and a magnet strap formed to connect between the nonfacing surfaces of the magnets to complete a magnetic circuit therebetween and having a pair of mutually parallel outer surfaces slidably fitting between said pads, the strap having a clearance from said bridge to permit translational and rotational location of the second arm relative to the facing pole surfaces and being attachable to the pads after said location.

2. The assembly according to claim 1, including a coil having a hollow bore, the second arm extending through said bore, the coil extending between the connecting portion of the armature and the magnet strap.

3. The assembly according to claim 2, in which the coil is attached at one end thereof to the magnet strap.

4. The assembly according to claim 1, in which the magnet strap forms a closed loop.

5. The assembly according to claim 1, in which said pads are adapted for welding to the magnet strap.

6. The assembly according to claim 2, including a viscoelastic damping body extending between said connecting portion and the coil.

7. The assembly according to claim 6, in which the armature has an aperture formed near the connecting portion for insertion of said damping body.

8. The assembly according to claim 7, in which the supported arm has a bulge in the region of said aperture to increase its magnetic flux carrying capability.

9. The assembly according to claim 1, in which the magnetic circuit establishes a magnetic center between the magnets, and the material comprising the bridge is plastically deformable within the limits of said clearance to permit essentially translational adjustment of the second arm relative to the magnetic center after said attachment.

10. The assembly according to claim 9, in which the magnet strap is attached to the pads with said clearance initially adapted to permit movement of the second arm toward said center upon said plastic deformation of the bridge.

* * * * *